US005704424A

United States Patent [19]

Kohno et al.

[11] Patent Number: 5,704,424

[45] Date of Patent: Jan. 6, 1998

[54] HEAT TRANSFER TUBE HAVING GROOVED INNER SURFACE AND PRODUCTION METHOD THEREFOR

[75] Inventors: Haruo Kohno; Takashi Kazama; Makoto Miyauchi; Yoshikatsu Arayama; Kohtaroh Nagahara; Shunroku Sukumoda, all of Aizuwakamatsu, Japan

[73] Assignee: Mitsubishi Shindowh Co., Ltd., Tokyo, Japan

[21] Appl. No.: 726,816

[22] Filed: Oct. 7, 1996

[30] Foreign Application Priority Data

| | | | |
|---|---|---|---|
| Oct. 19, 1995 | [JP] | Japan | 7-271337 |
| Oct. 26, 1995 | [JP] | Japan | 7-279498 |
| Oct. 27, 1995 | [JP] | Japan | 7-280870 |

[51] Int. Cl.[6] ..... F28F 1/40

[52] U.S. Cl. ..... 165/184; 138/171; 29/890.049; 165/DIG. 515; 165/DIG. 525

[58] Field of Search ..... 165/133, 184; 29/890.049; 138/171

[56] References Cited

U.S. PATENT DOCUMENTS

| | | | |
|---|---|---|---|
| 5,184,674 | 2/1993 | Keyes | 165/184 |
| 5,388,329 | 2/1995 | Randlett et al. | 29/890.049 |

FOREIGN PATENT DOCUMENTS

| | | | |
|---|---|---|---|
| 57-58093 | 4/1982 | Japan | 165/133 |
| 1-299707 | 12/1989 | Japan | 29/890.049 |
| 2-37294 | 2/1990 | Japan | 165/133 |
| 4-9210 | 1/1992 | Japan | 29/890.049 |

*Primary Examiner*—Allen J. Flanigan

*Attorney, Agent, or Firm*—Pearne, Gordon, McCoy & Granger LLP

[57] ABSTRACT

The object of the present invention is to offer a heat transfer tube having a grooved inner surface, wherein the side edges of the board material do not form a waved shape and cracks do not form during tube expansion. In order to achieve this object, the grooved-inner-surface heat transfer tube of the present invention has a metallic tube with an inner circumferential surface, on which are formed a weld portion which extends in an axial direction of this metallic tube, a pair of projecting strip portions formed parallel to and separate from this weld portion, and a plurality of fins formed in an area between these projecting strip portions. The fins are formed with a constant angle with respect to the tube axis, and the ends of these fins are connected with the projecting strip portions. The thickness of the metallic tube within the grooves formed between the fins is made to increase in approaching the weld portion within an area surrounding the weld portion wherein the central angle is within 30°~90° on both sides from the center of the weld portion.

17 Claims, 14 Drawing Sheets

HEAT TRANSFER TUBE HAVING GROOVED INNER SURFACE AND PRODUCTION METHOD THEREFOR

BACKGROUND OF THE INVENTION

1. Technical Field of the Invention

The present invention relates to grooved-inner-surface heat transfer tubes which have fins formed on the inner surfaces of metallic tubes, and production methods therefor.

2. Background Art

These types of heat transfer tubes having grooved inner surfaces are primarily used as evaporation tubes or condenser tubes in heat exchangers for air conditioners or cooling apparatus. Recently, heat transfer tubes having spiraling grooves formed over their entire inner surfaces and spiraling fins formed between these grooves have been widely marketed.

The heat transfer tubes which are presently common are produced by passing a floating plug having spiral grooves formed on the outer circumferential surface through the interior of a seamless tube obtained by drawing or extruding, so as to roll spiral grooves along the entire inner circumferential surface of the metallic tube. However, the shape and height of the fins in tubes produced in this manner are restricted by the properties of the floating plug, and there is a limit to the amount by which the heat exchange efficiency can be increased by improvements to the fins.

Therefore, the present inventors have been studying the employment of an "electrical seam welding method" for obtaining metallic pipes in the production of heat transfer tubes wherein, instead of using a seamless tube, a long metallic board material is rounded in the lateral direction and the side edges which are brought into contact to be welded together with the electrical seam welding method, the fins to be formed on the inner surfaces of the heat transfer tubes can be rolled onto the metallic board materials while they are still flat, thereby increasing the freedom of design in the shapes of the fins.

An example of a grooved-inner-surface heat transfer tube produced by an electrical seam welding method is shown in FIG. 13. This heat transfer tube 1 is a metallic tube with a circular cross-section, having multiple fins 2 which are mutually parallel and have a constant angle with the tube axis formed in spiraling fashion over almost the entire inner surface. Spiral grooves 3 are respectively formed between adjacent fins 2. Additionally, a weld portion 4 extends in the axial direction at one location on the inner surface of the heat transfer tube 1, and groove-shaped finless portions 5 which extend in the axial direction are formed at both sides of the weld portion 4, so that the fins 2 are separated by these finless portions 5.

However, it was discovered that with the conventional grooved-inner-surface heat transfer tube production methods, the side edges of the board material B do not form a straight line 5A, but instead form a slightly waved shape 5B as shown in FIG. 14. When this type of waved shape 5B occurs, gaps can form at the surface of contact during welding, so that the quality of the weld portion can become non-uniform. Therefore, when the waved shaped 5B is extreme, the side edges of the board material must be shaved down to form a linear shape in order to increase the reliability of the weld portion.

Recent research by the present inventors has revealed that the condensation and evaporation performance can be improved by increasing the amount of protrusion of the fins in the grooved-inner-surface heat transfer tube and giving the fins a thinner cross-sectional shape. However, forming fins with increased amounts of protrusion in this manner makes the waved shape 5B even more pronounced, thus presenting an obstacle to making taller fins.

Consequently, the present inventors conducted a detailed study into the mechanism whereby the waved shape 5B shown in FIG. 14 occurs, and arrived at the following conclusion. Since the pressure received by the material at the portions where the spiral grooves 3 are formed is greater than at the portions where the fins 2 are formed material flows from the ends of the spiral grooves 3 toward the finless portions 5. For this reason the areas corresponding to the ends of the spiral grooves 3 bulge outward so as to form the waved shape 5B.

Additionally, when grooved-inner-surface heat transfer tubes are produced by electrical seam welding, a second problem occurs as described below. When grooved-inner-surface heat transfer tubes are installed within a heat exchanger, the flow route through the heat exchanger weaves back and forth, so that work is required to arrange the heat transfer tubes in parallel fashion and connect the end portions of the heat transfer tubes with U-shaped tubes. In this case, the usual method is to widen the end portions of the heat transfer tubes 1 into tapered shapes using a conical tube expander P having a pointed tip as shown in FIG. 15, after which the end portions of the U-shaped tubes are inserted into these expanded portions and welded.

However, with conventional grooved-inner-surface heat transfer tubes, cracks sometimes form in the spiral grooves 3 adjacent to the weld portion 4 during tube expansion, thus reducing the yield.

Usually, care is taken to make sure that the thickness of the metallic tube in the spiral grooves 3 is constant over the entirely of each spiral groove 3. Therefore, the strength of the metallic tube in the spiral grooves 3 on either side of the weld portion should not be especially low.

Thus, the present inventors conducted a detailed study of this phenomenon, as a result of which they discovered that cracks occur in these locations because the spreadability of the material during tube expansion at the weld portions 4 which must be relatively thick is inferior, so that stress is concentrated at the portions in the spiral grooves 3 near the weld portions 4 which are thereby strongly pulled in the circumferential direction, making it easier for cracks to form.

SUMMARY OF THE INVENTION

The first object of the present invention is to offer a heat transfer tube having a grooved inner surface and a production method thereof, which can prevent the formation of a waved shape at the edges of the board material while having high reliability.

In order to achieve the above object, a heat transfer tube having a grooved inner surface according to the present invention comprises a metallic tube having an inner circumferential surface; a weld portion formed on the inner circumferential surface of the metallic tube, extending in an axial direction of the metallic tube; a pair of projecting strip portions formed on the inner circumferential surface of the metallic tube, parallel to the weld portion and separated from the weld portion; and a plurality of fins formed in an area between the pair of projecting strip portions which does not include the weld portion.

Additionally, a method for producing a heat transfer tube having a grooved inner surface according to the present invention comprises a rolling step of running a metallic board material between at least one pair of fin forming rollers so as to roll onto a surface of the board material a pair of weld portions parallel to both side edges of the board material and respectively separated from the side edges, and a plurality of fins which are arranged in an area between the weld portions; a tube forming step of passing the board material onto which the weld portions and the fins have been formed through a plurality of forming rollers so as to form the board material into a tube with the weld portions and the fins positioned on the inside surface; and a welding step of heating both side edges of the board material which has been formed into a tube shape and adjoining the side edges.

With the above-mentioned grooved-inner surface heat transfer tube and production method thereof, even if material flows from the ends of the grooves to the finless portions when the fins are rolled onto the board material, this material flow is stemmed by means of the projecting strip portions formed between the grooves and the finless portions so as to prevent the formation of waved shapes in the side edges of the board material. Consequently, flaws in the weld portion occurring due to the waved shapes can be prevented so as to increase the reliability of the grooved-inner-surface heat transfer tube.

Additionally, with this grooved-inner-surface heat transfer tube, a pair of parallel projecting strip portions are formed on both sides of the weld portion, so that the areas around the weld portions can be reinforced to increase the reliability of the grooved-inner-surface heat transfer tube from this standpoint as well.

The second object of the present invention is to offer a grooved-inner-surface heat transfer tube and production method thereof, which can prevent the formation of cracks within the grooves adjacent to the weld portion during tube expansion.

In order to achieve this object, a second heat transfer tube having a grooved inner surface according to the present invention, comprises a metallic tube having an inner circumferential surface; a plurality of fins formed on the inner circumferential surface of the metallic tube so as to protrude from the inner circumferential surface; and a weld portion formed on the inner circumferential surface of the metallic tube, extending in an axial direction of the metallic tube; wherein the thickness of the metallic tube in groove portions formed between the fins is formed such as to increase in approaching the weld portion in an area surrounding the weld portion wherein the central angle is within 30°~90° on both sides from the center of the weld portion.

With this grooved-inner-surface heat transfer tube, the metallic tube thickness within the grooves in the areas surrounding the weld portion gradually increases in approaching the weld portion from the outer area side, so that during tube expansion, stress will not be concentrated at the bottom portions of the spiral grooves positioned near the weld portion even if the spreadability is poor at the thick weld portion, thereby preventing the formation of cracks in these locations. As a result, the yield after tube expansion is able to be increased and the reliability of the heat transfer tube is able to be improved.

A second method for producing a heat transfer tube having a grooved inner surface according to the present invention comprises a rolling step of running a metallic board material between at least one pair of fin forming rollers so as to roll onto a surface of the board material a plurality of fins which protrude from the surface, such that the thickness of the board material in groove portions between the fins increases in approaching side edges of the board material within areas around the side edges extending to 10~30% of the width of the board material; a tube forming step of passing the board material onto which the fins have been formed through a plurality of forming rollers to form the board material into a tube shape with the fins positioned on the inside; and a welding step of heating both side edges of the board material which has been formed into a tube shape and adjoining the side edges.

With this production method for a grooved-inner-surface heat transfer tube, the thickness of the side edges is made relatively large so that the edges will not curve inside the tube when the side edges of the board material onto which fins have been rolled are joined and welded together, thereby preventing inward protrusions of the weld portion due to the sinking of the side edges, so as to improve the reliability of the grooved-inner-surface heat transfer tube from this standpoint as well.

In order to achieve the above-mentioned second object, a third heat transfer tube having a grooved inner surface according to the present invention comprises a metallic tube having an inner circumferential surface; a plurality of fins formed on the inner circumferential surface of the metallic tube so as to protrude from the inner circumferential surface; and a weld portion formed on the inner circumferential surface of the metallic tube, extending in an axial direction of the metallic tube; wherein the bottom widths of groove portions formed between the fins are formed such as to gradually increase in approaching the weld portion in an area surrounding the weld portion wherein the central angle is within 30°~90° on both sides from the center of the weld portion.

With this type of grooved-inner-surface heat transfer tube, the bottom widths of the grooves in the area surrounding the weld portion are made to gradually increase from the outer area side toward the weld portion side, so that even if the spreadability at the thick weld portion is poor, the spreadability within the grooves in the area surrounding the weld portion is good, so that stress is not concentrated at the bottom portions of the spiral grooves positioned near the weld portion due to a buffering effect during tube expansion, thereby preventing cracks from forming. As a result, the yield after the tube expansion procedure can be increased, and the reliability of the heat transfer tube can be improved.

A method for producing a third heat transfer tube having a grooved inner surface according to the present invention comprises a rolling step of running a metallic board material between at least one pair of fin forming rollers so as to roll onto a surface of the board material a plurality of fins which protrude from the surface, such that the bottom widths the groove portions between the fins increases in approaching side edges of the board material within areas around the side edges extending to 10~30% of the width of the board material; a tube forming step of passing the board material onto which the fins have been formed through a plurality of forming rollers to form the board material into a tube shape with the fins positioned on the inside; and a welding step of heating both side edges of the board material which has been formed into a tube shape and adjoining the side edges.

PREFERRED EMBODIMENTS OF THE INVENTION

Figure 1:
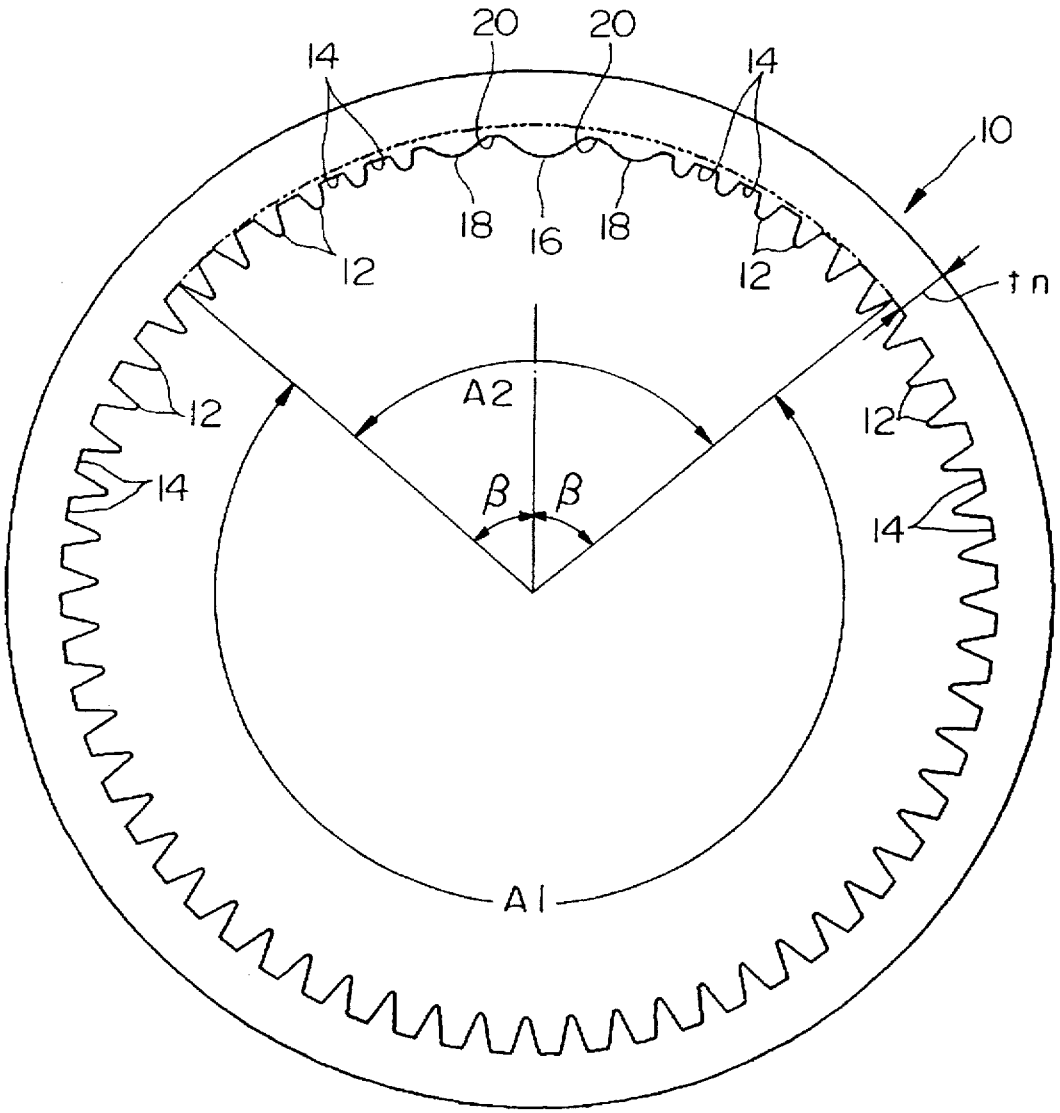
FIG. 1 is a section view showing an embodiment of the grooved-inner-surface heat transfer tube according to the present invention.

FIG. 1 is a section view showing an embodiment of a grooved-inner-surface heat transfer tube according to the present invention. This grooved-inner-surface heat transfer tube 10 comprises a metallic tube having an inner circumferential surface provided with a weld portion 16 extending in the axial direction of this metallic tube, a pair of projecting strip portions 18 formed separate from but parallel to this weld portion 16, and multiple fins 12 formed in the area on the side not containing the weld portion 16 of the areas between the projecting strip portions 18.

Figure 2:
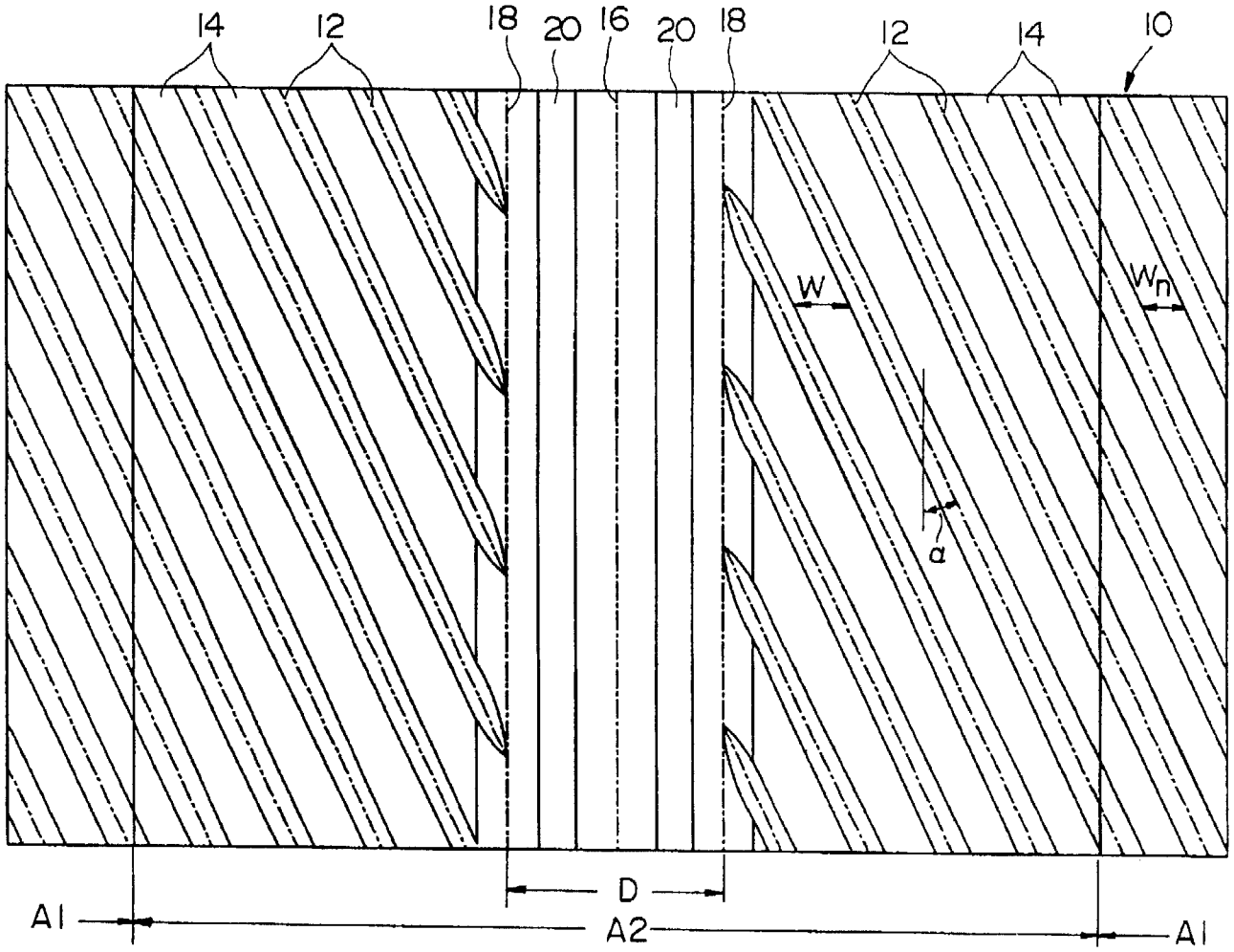
FIG. 2 is a spread-open view showing the inner surface of the same grooved-inner-surface heat transfer tube.

In this embodiment, the fins 12 form a constant angle (spiral angle) $\alpha$ of intersection with the axis as shown in FIG. 2, and form spirals centered around the tube axis. The spiral angle $\alpha$ has a value determined by the properties desired of the heat transfer tube 10, but is not especially restricted in the present invention.

In this embodiment, the end portions of each fin 12 are respectively coupled to the projecting strip portions 18. By forming projecting strip portions 18 and coupling the end portions of the fins 12 to these projecting strip portions 18, it is possible to gain the effect of making it difficult for waving deformations to occur at the edges of the board material B when the fins 12 are rolled onto the surface of the board material B by the method to be explained below. On the other hand, it is also possible to have a structure wherein the ends of the fins 12 are not coupled to the projecting strip portions 18.

The distance between the center lines of the projecting strip portions 18 is not particularly restricted for the present invention, but should preferably be 1~7% of the entire circumference of the inner surface of the metallic tube, more preferably 2~5%, and most preferably 3~4.5%. If the distance D is within the range of 1~7%, then not only will the occurrence of waving deformations on the edges of the board material B during the rolling of the fins 12 be suppressed, but the effect of reinforcement in the areas around the weld portion by the projecting strip portion 18 will also be increased.

The amount of protrusion of the projecting strip portion 18 from the inner surface of the metallic tube should preferably be 10~80% of the amount of protrusion of the fins 12 in the outer area A1, more preferably 15~70%. Within the range of 10~80%, there is little risk of the projecting strip portions 18 contacting the tube expander plug during tube expansion, while allowing sufficient reinforcement strength to be gained from the projecting strip portion 18.

Figure 3:
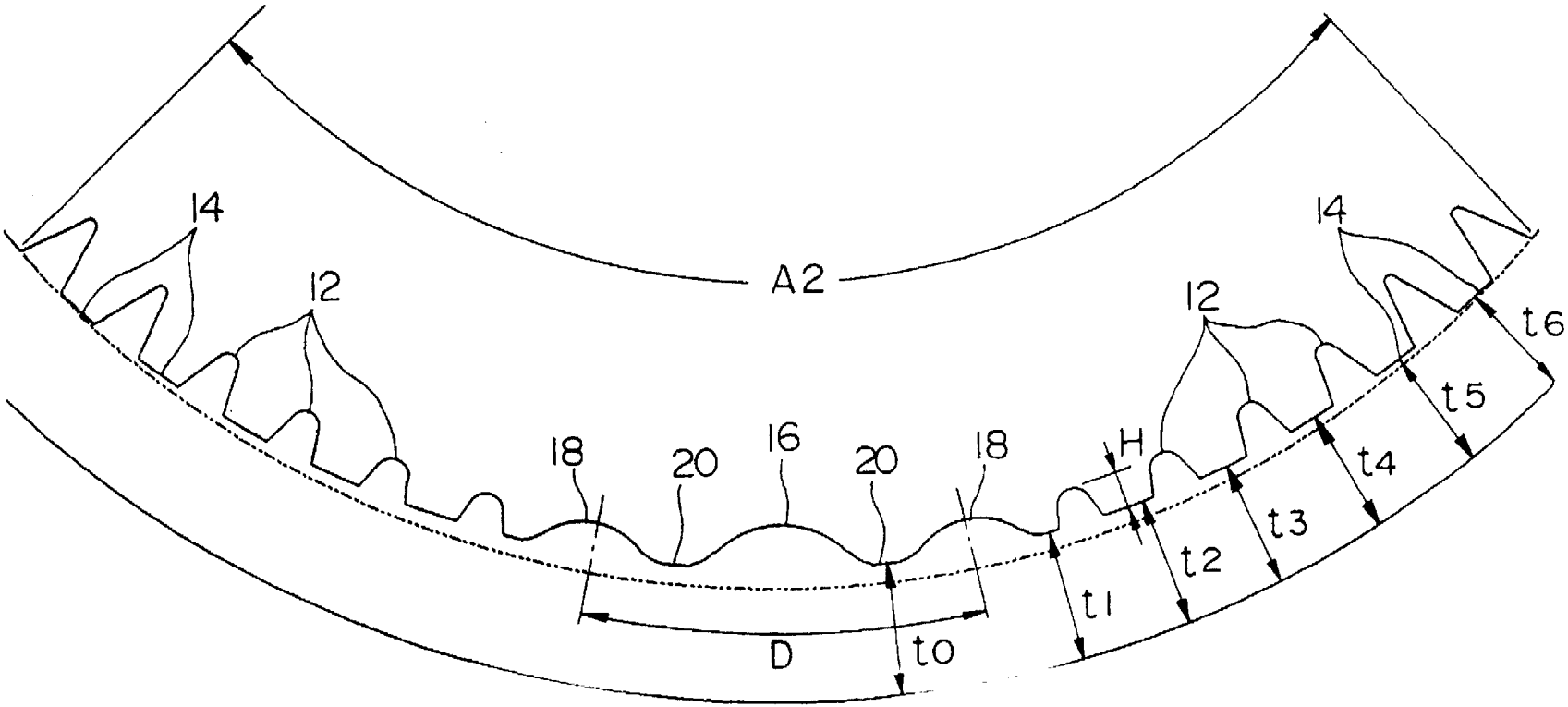
FIG. 3 is an enlarged section view showing the area around the weld portion of the same grooved-inner-surface heat transfer tube.

Additionally, with this embodiment, the portions of the fins 12 in an area A2 within a constant distance from the projecting strip portions 18 have heights H from the inner surface of the metallic tube which gradually decrease in approaching the projecting strip portions 18, as shown in FIG. 3. At the portions of coupling to the projecting strip portions 18, the heights are approximately equal to those of the projecting strip portions 18, so that the ridgelines of the fins 12 and the ridgelines of the projecting strip portions 18 are continuous as shown in FIG. 2. On the other hand, the heights H of the fins 12 are constant in the area A1 of the fins 12 outside of the area A2. Of course, in the present invention, the heights of the fins in the area A1 do not have to be constant, and it is possible for the heights to change in portions.

As shown in FIG. 1, the area A2 around the weld portion should preferably extend to within the range of a central angle $\beta$=30°~90° on both sides of the center of the weld portion 16. Furthermore, as shown in FIG. 3, the metallic tube thickness (denoted as t1~t6 in the drawing) in the spiral grooves 14 within the area A2 around the weld portion should preferably be formed so as to gradually increase in approaching the weld portion 16.

In the other area A1, the thickness of the metallic tube (denoted as tn) in the spiral grooves 14 should preferably be constant within a range of tolerance. The double-dotted chain line in the drawing indicates the hypothetical surface of the inner surface of the tube within the area A1. The thickness (denoted as t0) of the metallic tube within the groove portions 20 between the weld portion 16 and the projecting strip portion 18 is made greater than the maximum value for the thickness of the metallic tube in the spiral grooves 14 of the area around the weld portion. The above relationships can be expressed by the following equation:

$$t0>t1>t2>t3>t4>t5>t6>\ldots>tn$$

Figure 15:
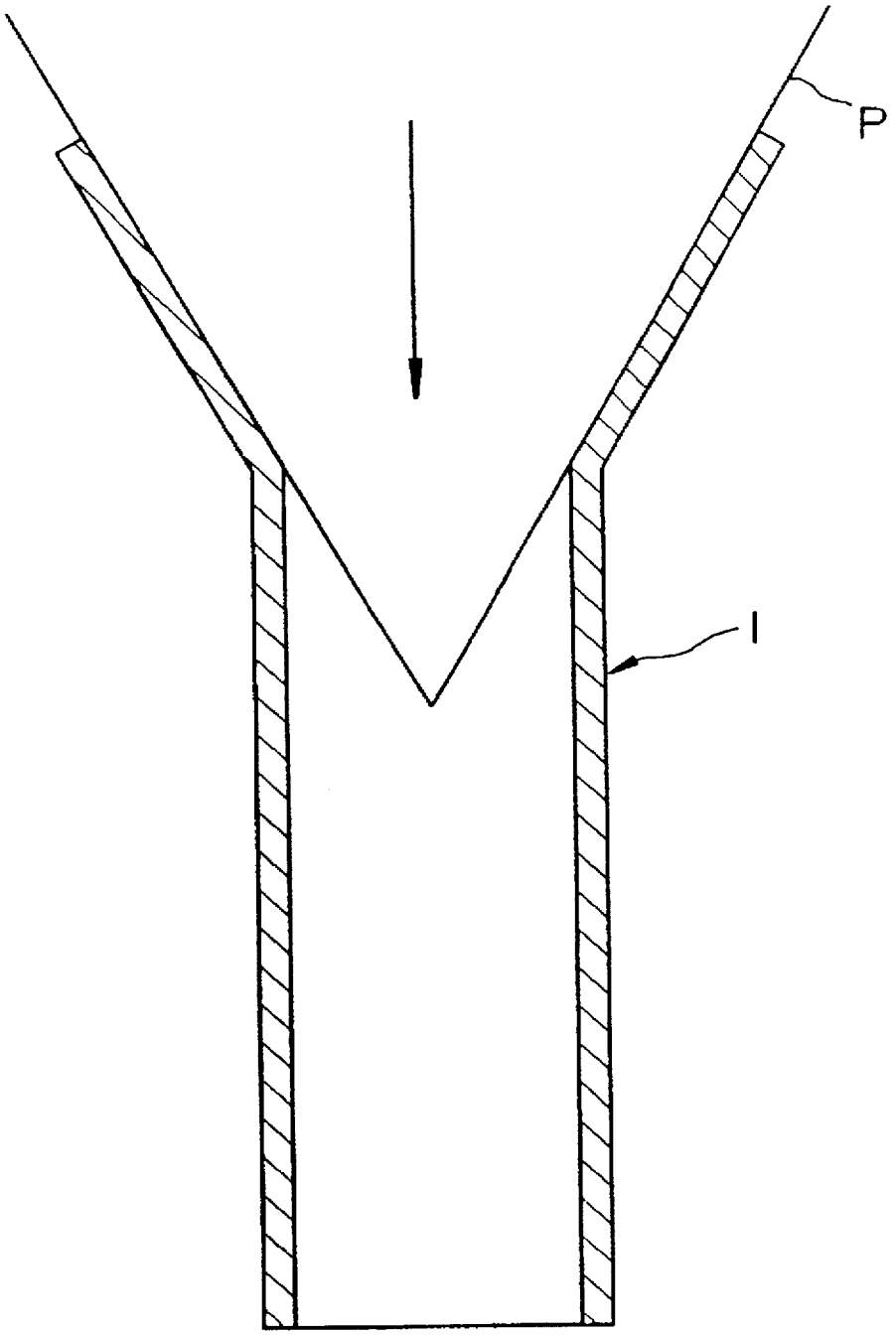
FIG. 15 is an enlarged view showing a second problem point on an end portion of a board material according to the conventional art.

If the central angle $\beta$ is within the above range, the spread of the material in the spiral grooves 14 is approximately uniform over the entire area A2 around the weld portion when the heat transfer tube 10 is expanded into a tapered shape as shown in FIG. 15, so that stresses is not concentrated at the bottom portions of the grooves 14 adjacent to the weld portion 16 and cracks are prevented from forming in the metallic tube. On the other hand, if the central angle $\beta$ lies outside this range, the formation of cracks in the metallic tube at the area A2 around the weld portion cannot be adequately suppressed. That is, if the central angle $\beta$ is less than 30°, the area over which the bottom thicknesses can change is too small, so that the concentration of stress near the weld portion 16 during tube expansion cannot be adequately prevented. If the central angle is greater than 90°, the area over which the thickness increases is too large, so that the spread during tube expansion is made worse and stress concentrate in the area around the weld portion 16. The value of the central angle β should more preferably be 50°~80°. However, the present invention is not restricted to this composition, and the thickness of the metallic pipe can be made constant over the entire surface.

The maximum thickness t1 of the metallic tube within the spiral grooves 14 in the area A2 around the weld portion should preferably be 103~125% of the thickness of the metallic tube within the spiral grooves 14 in the outer area A1. At less than 103%, the effects of the present invention cannot be sufficiently gained, and there is usually no need for it to be greater than 125%. A thickness within the range of 105~115% is more preferable.

Additionally, the thickness to of the metallic tube in the groove portion 20 should preferably be 105~135% of the thickness tn of the metallic tube in the spiral grooves 14 of the outer area A1. At less than 105% there is a possibility of cracks forming in the metallic tube within the groove portions 20, while there is normally no need for the thickness to be greater than 135%. A thickness within the range of 110~125% is more preferable.

The thickness of the metallic tube at the weld portion 16 including the height of the weld portion 16 is slightly less than the metallic tube thickness including the height of the fins within the area A1. As a result, the tip of the weld portion 16 is positioned slightly further outward in the radial direction than are the tips of the fins 12. If the tip of the weld portion 16 protrudes further inward than the tips of the fins 12, then galling may occur between the weld portion 16 and the tube expander plug when expanding the tube in order to affix heat radiating fins on the outer circumference of the heat transfer tube 10. Additionally, if the tip of the weld portion 16 is positioned much further outward than the tips of the fins, then a depression can be formed on the outer circumferential surface of the tube at a position corresponding to the weld portion 16 during the tube expansion process, thereby reducing the degree of cylindricity of the heat transfer tube 10 and risking instability of the heat radiating fins.

Figure 4:
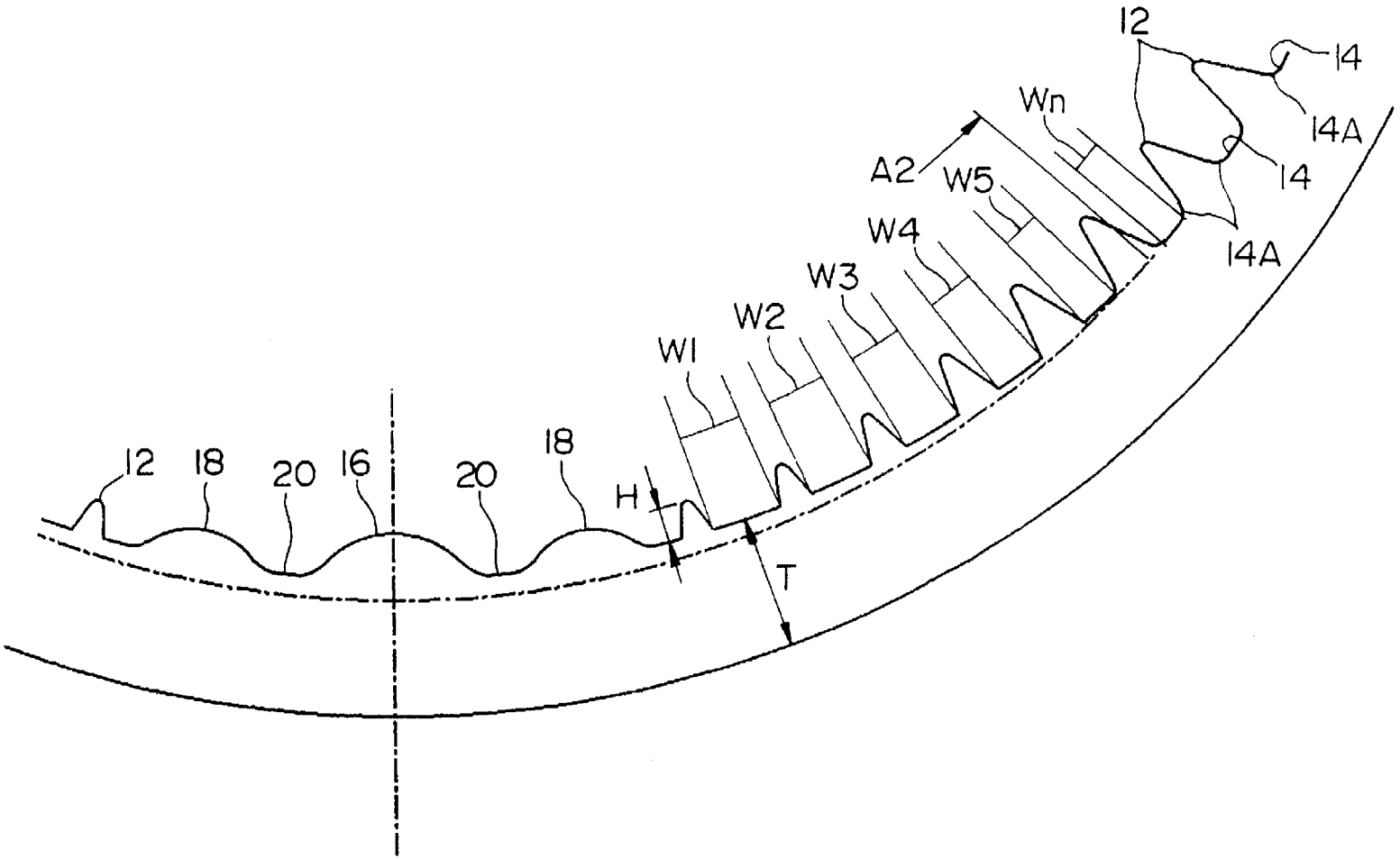
FIG. 4 is an enlarged section view showing the area around the weld portion of the same grooved-inner-surface heat transfer tube.

Additionally, in this embodiment, the bottom widths W (denoted as W1~W5 in FIG. 4) of the spiral grooves 14 in the area A2 around the weld portion gradually increase in approaching the weld portion 16. In the outer area A1, the bottom widths (denoted as Wn) of the spiral grooves are made constant within a range of tolerance. That is, the following relationship is established.

$$W1>W2>W3>W4>W5>\ldots>Wn$$

In this way, the breakage of the metallic tube near the weld portion 16 can be prevented even if the bottom widths W of the spiral grooves 14 are changed. Therefore, even if the metallic tube thickness t in the spiral grooves 14 is not formed so as to gradually increase in approaching the weld portion 16, the breakage of the metallic tube can be prevented to a certain degree as long as the bottom widths W are formed so as to gradually increase in approaching the weld portion 16. Conversely, even if the bottom widths W are not formed so as to gradually increase in approaching the weld portion 16, the breakage of the metallic tube can also be prevented to a certain degree as long as the metallic tube thicknesses t1~t6 in the spiral grooves 14 are gradually increased in approaching the weld portion 16. Since this embodiment has both features, the breakage prevention effect is further improved. Additionally, the breakage prevention effect during tube expansion can be obtained without forming the projecting strip portions 18.

The maximum bottom width W of the spiral grooves 14 in the area A2 around the weld portion should preferably be 102~130% of the width of the spiral grooves 14 in the outer area A1. At less than 102%, the effects of the present invention cannot be sufficiently gained, and there is normally no need for it to be greater than 130%. A thickness within the range of 108~120% is more preferable.

Furthermore, if the central angle β of the area A2 around the weld portion is 30°~90°, the expansion of the metallic tube walls within the spiral grooves 14 positioned within the area A2 around the weld portion is improved when the heat transfer tube 10 is expanded into a tapered shape as shown in FIG. 15, so that the tow expansion at the weld portion 16 is aided to provide a buffer effect which prevents concentration of stress at the bottom portions of the spiral grooves 14 adjacent to the weld portion 16, thereby preventing cracks from forming in the metallic tube. On the other hand, if the central angle β is less than 30°, an adequate buffering effect cannot be gained so that the effect of preventing stress concentrations near the weld portion 16 during tube expansion is reduced, while if the central angle β is greater than 90°, the expansion balance is made worse so that stress is concentrated near the weld portion 16 and cracks cannot be sufficiently prevented from forming in the metallic tube. The value of the central angle β should more preferably be within the range of 50°~80°.

In order to change the bottom widths W of the spiral grooves 14 in the area A2 around the weld portion in this embodiment, the pitch of the fins 12 is held constant over all areas, while the heights of the fins 12 are gradually reduced in approaching the weld portions 16 to adjust the bottom widths W, In this specification, the bottom widths W are defined to be the circumferential distances between the hypothetical extensions of the side surfaces of the fins 12 and the hypothetical extensions of the bottom surfaces of the spiral grooves 14.

Furthermore, in this embodiment, the boundary edges between the side surfaces of the fins 12 and the bottom surfaces of the spiral grooves 14 in the outer area A1 are curved (made into arcs). On the other hand, the boundary edges between the side surfaces of the fins 12 and the bottom surfaces of the spiral grooves 14 in the area A2 around the weld portion have almost no arcs or have arcs with radii of curvature which gradually decrease in the direction of the projecting strip portions 18. As a result, the expansion of the bottom surfaces of the spiral grooves 14 in the outer area A1 is suppressed. That is, when the heat transfer tube 10 is expanded, the entire bottom surfaces of the spiral grooves 14 expand in the portions without arcs in the spiral grooves 14, while only the roughly flat portions between the arcuate surfaces of the spiral grooves mainly expand in the portions with arcs, thereby effectively reducing the bottom widths of the spiral grooves 14.

However, the present invention is not restricted to this structure, and the heights H of the fins 12 can be made constant as long as the metallic tube thicknesses in the bottom portions of the spiral grooves are made constant. In this case, the widths W of the spiral grooves 14 can be effectively adjusted by either changing the pitch of the fins 12 or putting arcs at the bases of the fins 12.

Figure 5:
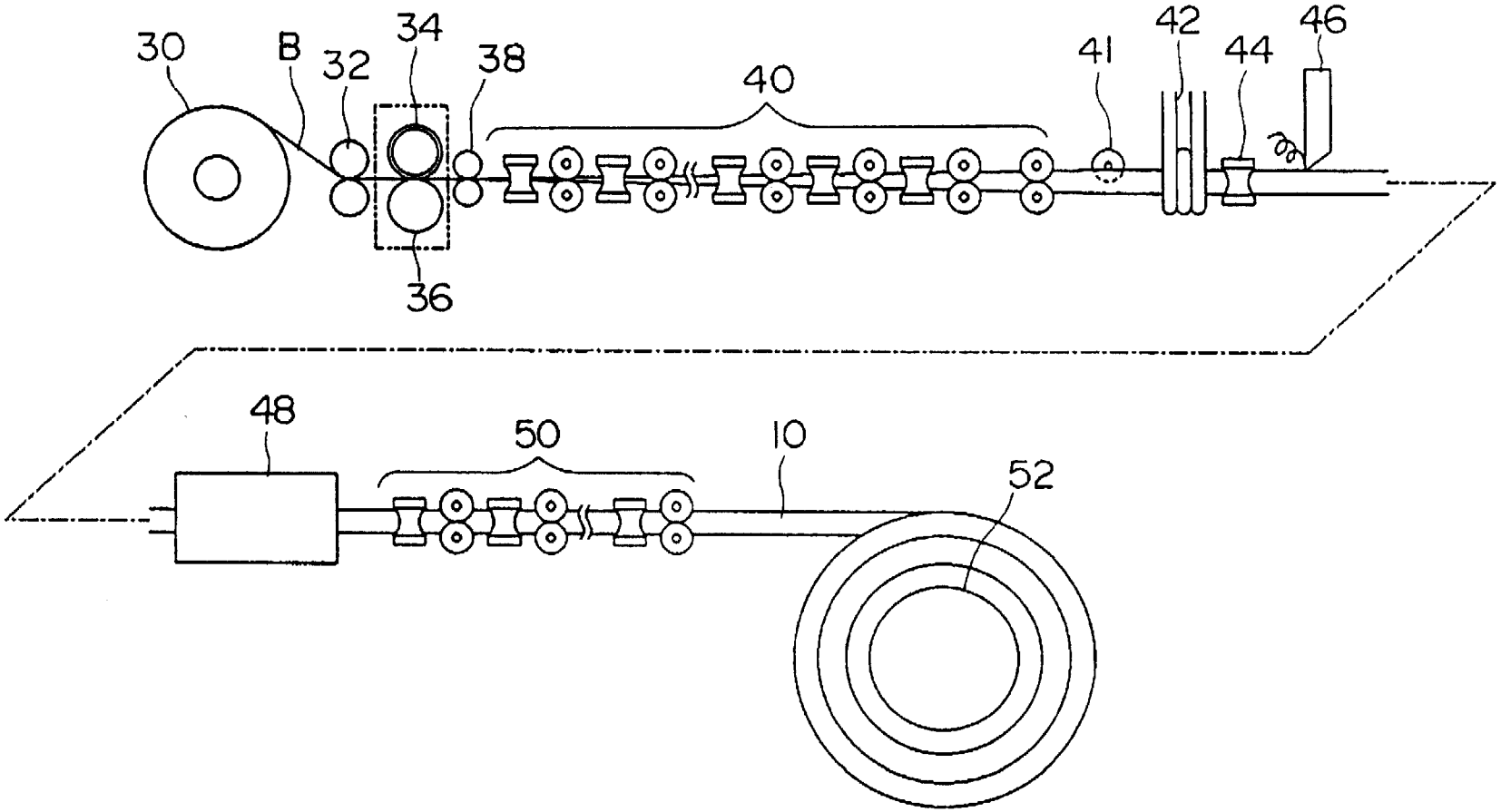
FIG. 5 is a side view showing an example of a production apparatus for the same grooved-inner-surface heat transfer tube.
Figure 8:
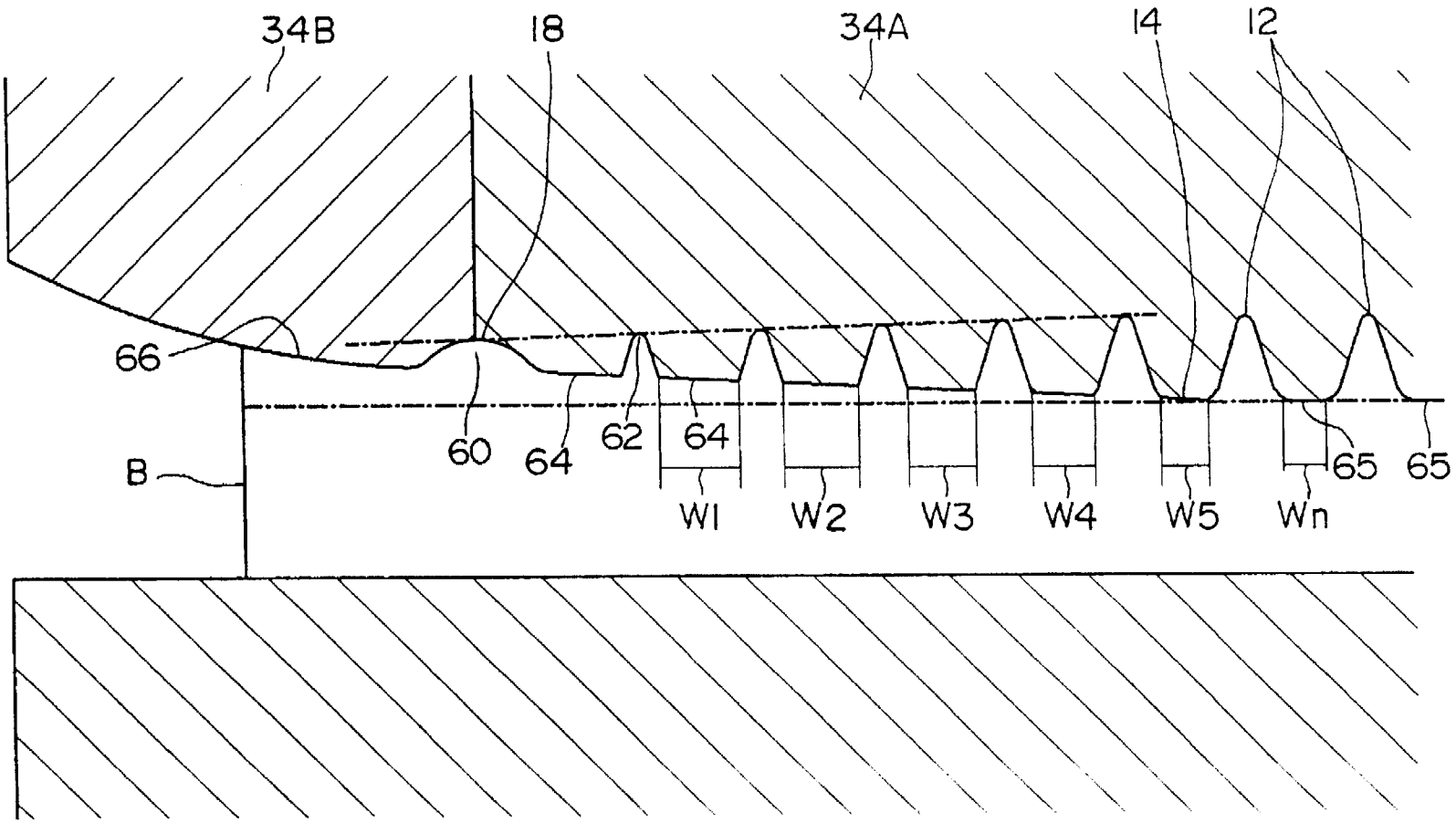
FIG. 8 is an enlarged view showing the same fin-forming roller rolling fins onto a board material.
Figure 9:
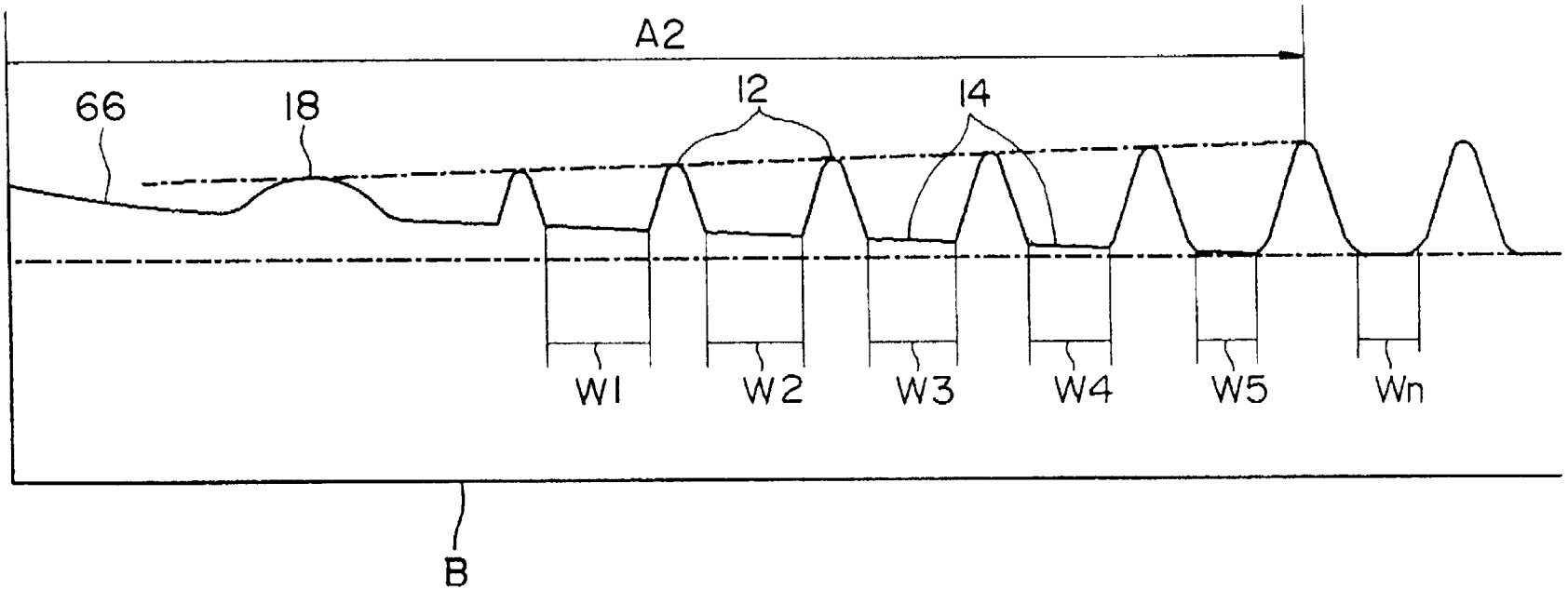
FIG. 9 is an enlarged section view showing an end portion of the board material immediately after rolling.
Figure 10:
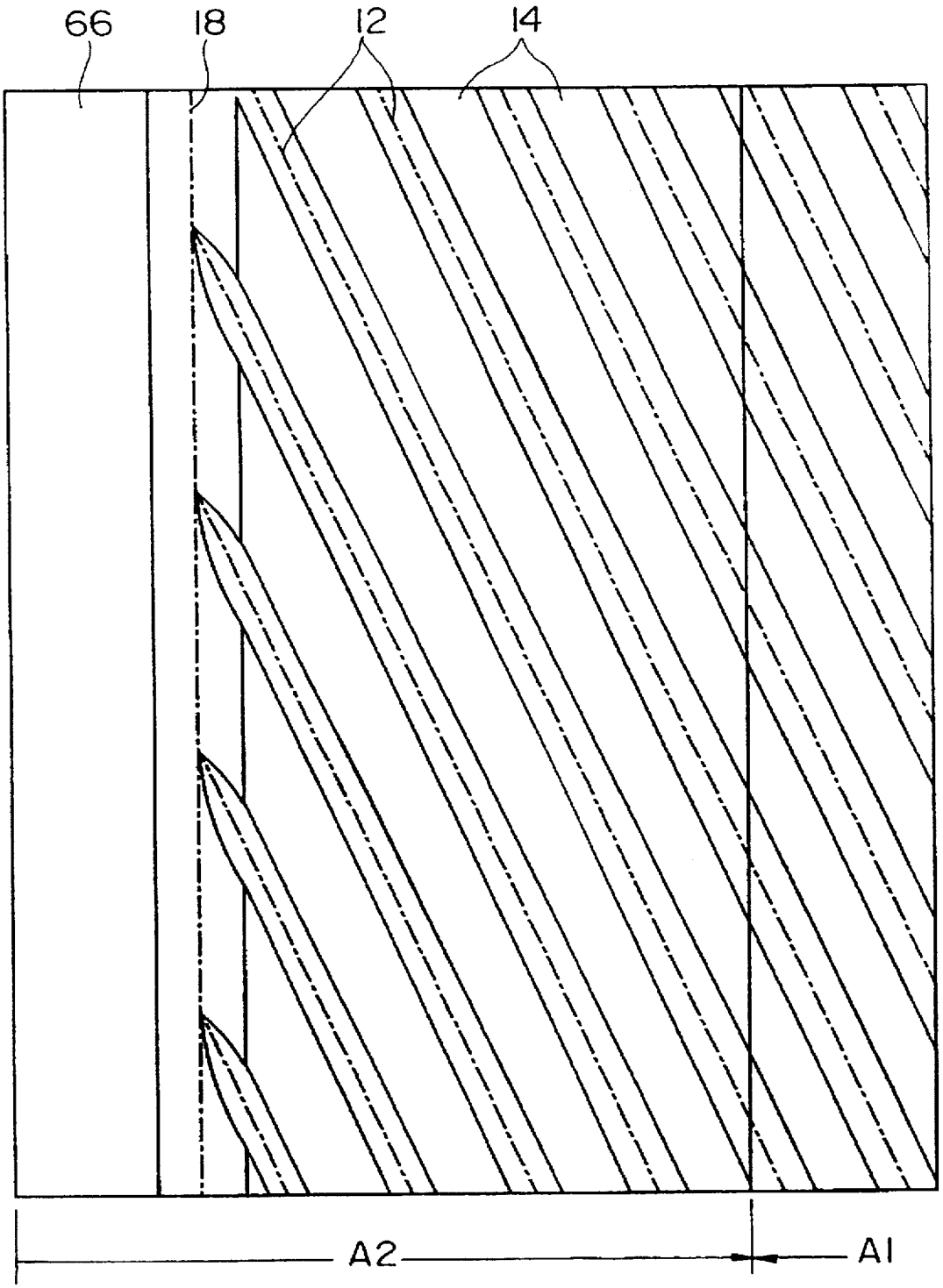
FIG. 10 is a plan view showing an end portion of the board material immediately after rolling.

FIG. 5 is a side view showing an example of a production apparatus for the heat transfer tube 10 of the above embodiment. Reference numeral 30 denotes an uncoiler for continuously unraveling a metallic board material B of a constant width. The unraveled board material B passes through a pair of supporting rollers 32, then through a grooved roller 34 and a flat roller 36 which form a pair (collectively referred to as groove-forming rollers). The grooved roller 34 forms the projecting strip section 18, the fins 12 and the spiral grooves 14 as shown in FIGS. 8~10. In the present embodiment, fins 12 are formed on only the front surface of the board material B, while the rear surface is held flat.

Figure 6:
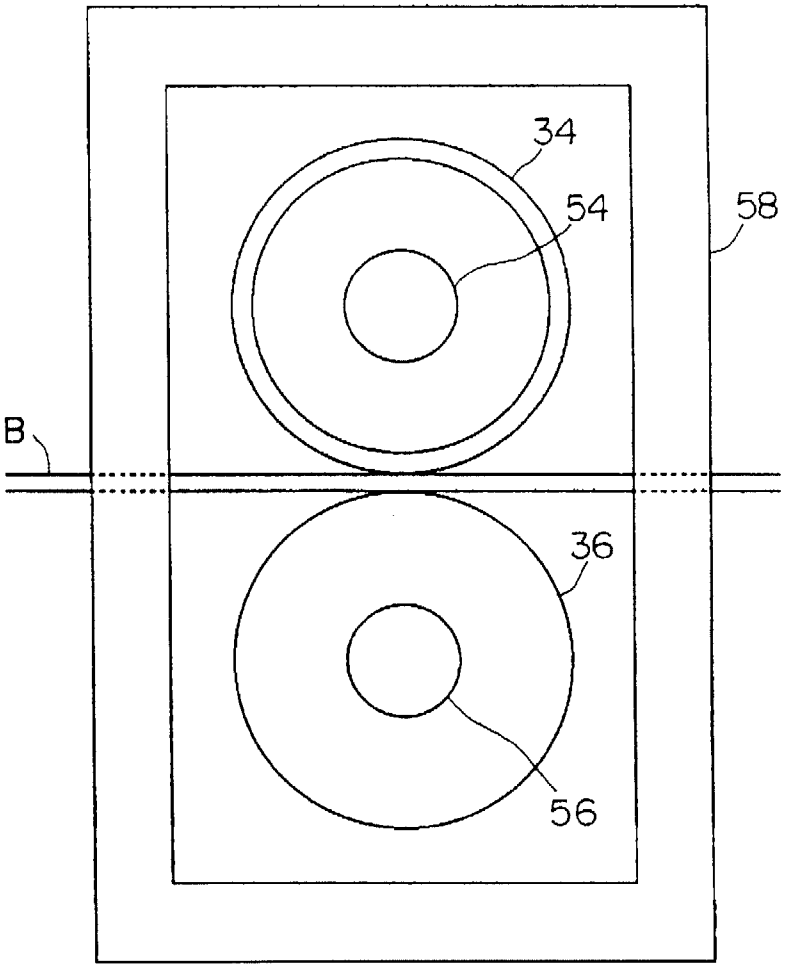
FIG. 6 is a side view showing a fin-forming roller of the same production device.
Figure 7:
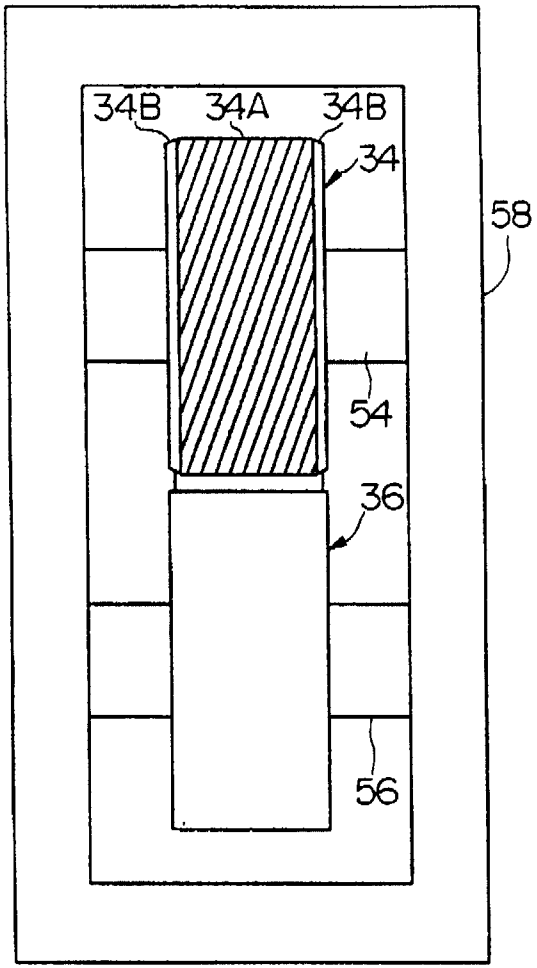
FIG. 7 is a front view showing the same fin-forming roller.

FIGS. 6~8 are detailed views of the grooved roller 34 and the flat roller 36. These rollers 34, 36 are respectively supported by the frame 58 so as to be capable of rotating about the shafts 54, 56. As shown in FIGS. 7 and 8, the grooved roller 34 comprises a main grooved roller 34A having transfer grooves 62 formed on the outer circumferential surface, and a pair of side rollers 34B affixed to both sides thereof. While the transfer grooves 62 form the fins 12 on the board material B, the projecting strip portions 64 between the transfer grooves 62 form the spiral grooves 14.

The outer circumferential surface (the tips of the projecting strip portions 64) at the central portion of the main grooved roller 34A forms a precise cylindrical surface. On the other hand, the outer circumferential surfaces (the tips of the projecting strip portions 64) on both side portions with respect to the axis of the main grooved roller 34 are conical surfaces having outer diameters which decrease in the direction of the side rollers 34B. As a result, the thickness of the board material B in the area A2 of the spiral grooves 14 is made to gradually increase in the direction of the projecting strip portion 18. Additionally, in the same portion, the depths of the transfer grooves 62 are made to gradually decrease in the directions of the ends of the main grooved roller 34A, so that the heights of the fins 12 formed in the board material B get smaller in approaching the projecting strip portion 18 within the area A2 around the weld portion. The edges forming the boundaries between the transfer grooves 62 and the projecting strip portions 64 of the grooved roller 34 can either be chamfered or left unchamfered.

As shown in FIG. 8, projecting-strip-portion-forming grooves 60 are formed around the entire circumference at the boundaries between the grooved roller 34A and the side rollers 34B. These projecting-strip-portion-forming grooves 60 form projecting strip portions 18 which extend in the longitudinal direction along the entire length of the board material B at positions separated by a constant distance on both sides of the board material B. In this embodiment, the cross-sectional shapes of the projecting-strip-portion-forming grooves 60 are arcuate, but they may have a triangular cross-section as an alternative.

The board material B which has been processed by the grooved roller 34 and the flat roller 36 to form grooves then passes through a pair of rollers 38 as shown in FIG. 5, and is gradually rounded into a tubular shape through a plurality of forming rollers 40 arranged in pairs. After the gap between the edges which are to be connected is made uniform by means of a rolling separator 41, both side edge portions are heated by passing through an induction heating coil 42. The board material B which has been formed into a tube and heated is passed through a pair of squeeze rollers 44 to be pressed from both sides so that the heated edge portions are pushed together and welded. Since extruded weld material forms beads on the outer surface of the heat transfer tube 10 welded in this way, a bead cutter is provided to remove these beads.

After the beads have been removed, the heat transfer tube 10 is passed through a cooling vat 48 for forced cooling, then passed through a plurality of sizing rollers 50 arranged in pairs so as to contract it to a designated outer diameter. Subsequently, the contracted heat transfer tube 10 is coiled up by a rough coiler 52.

Next, an embodiment of a production method for a grooved-inner-surface heat transfer tube using the above apparatus will be explained.

In the method of this embodiment, a board material B of a constant width is first continuously unraveled from an uncoiler 32. Then the unraveled board material B is passed through a pair of support rollers 32, and passed between a grooved roller 34 and a receiving roller 36 to form projecting strip portions 18, fins 12 and spiral grooves 14 by means of the grooved roller 34 as shown in FIGS. 8~10.

The material of the board material B may be any material if it is copper or a copper alloy, and similar effects can be gained by the application of not only phosphorus-deoxidized copper (such as JIS 1220 alloy) which is commonly used as a material for heat transfer tubes, but also of oxygen-free copper, copper alloys, aluminum, aluminum alloys and copper.

When the present invention is applied to the production of heat transfer tubes having an outer diameter of 3~15 mm which is common, the thickness of the board material B prior to groove formation should preferably be 0.3~1.2 mm, and the depths of the spiral grooves 14 (=the heights of the fins 12) formed in the board material B should preferably be 30~60% of the thickness of the board material B. Specifically, in the present invention, the heights of the fins 12 can be made higher than in conventional products while preventing the occurrence of waved shapes on the side edges of the board material B, in which case the drainability and turbulence creation effects at the tips of the fins 12 are increased, thus offering the advantage of better heat exchange performance than is capable of being obtained by conventional seamless tubes.

Next, the board material B in which grooves are formed is gradually rounded into a tubular shape by passing through a pair of rollers 38 and a plurality of forming rollers 40 arranged in pairs as shown in FIG. 5, after which the distance between the edges to be joined together is held constant by means of a rolling separator 41. Then, the side edges are heated by passing through an induction heating coil 42, and the side edges are joined and welded by being pressed from both sides by passing through a pair of squeeze rollers 44. Since weld material extruded onto the outer circumferential surface of the heat transfer tube forms beads, these beads are removed by a bead cutter 46.

The heat transfer tube 10 with the beads removed is cooled by passing through a cooling vat 48, and contracted to a designated outer diameter by passing through a plurality of sizing rollers 50 arranged in pairs. The heat transfer tube 10 contracted in this way is coiled up by a rough coiler 52. However, these steps are used with the apparatus of FIG. 5, and of course may be changed according to the structure of the apparatus.

According to the grooved-inner-surface heat transfer tube and production method of this embodiment described above, even if material flows from the ends of the spiral grooves 14 to the finless portions 66 when the fins 12 and the spiral grooves 14 are rolled onto the board material B, this material flow is stemmed by the projecting strip portions 18 formed between the spiral grooves 14 and the finless portion 66, and the formation of a waved shape at the edges of the board material B can be prevented. Consequently, it is possible to prevent flaws in the weld portion 16 occurring due to this waved shape, so as to increase the reliability of the grooved-inner-surface heat transfer tube 10.

Additionally, according to this grooved-inner-surface heat transfer tube, the weld portion 16 which has been softened by recrystallization after welding is surrounded on both sides by a pair of parallel projecting strip portions 18 which have been hardened by rolling, so that the area around the weld portion 16 is reinforced and the relative strength around the weld portion can be prevented from decreasing.

Additionally, according to the grooved-inner-surface heat transfer tube 10 of this embodiment, the metallic tube thickness in the spiral grooves 14 positioned within the area A2 around the weld portion gradually increases in the direction from the outer area A1 to the projecting strip portions 18. Therefore, when the heat transfer tube 10 is expanded by the tube expander P as shown in FIG. 15, even if the spreadability of the thickness at the weld portion 16 is poor, stress can be prevented from concentrating at the bottom portions of the spiral grooves positioned around the weld portion 16 so as to prevent cracks from forming there. As a result, the yield after tube expansion can be increased and the reliability of the heat transfer tube 10 can be improved.

Additionally, according to the grooved-inner-surface heat transfer tube 10 of the above embodiment, the bottom widths W of the spiral grooves 14 positioned in the area A2 around the weld portion gradually increase from the outer area A1 side to the projecting strip 18 side, so that when the heat transfer tube 10 is expanded with the tube expander P, even if the spreadability of the spiral grooves positioned around the weld portion 16 is poor, the spreadability within the spiral grooves of the area A2 around the weld portion is improved so as to prevent stress from being concentrated at the bottoms of the spiral grooves 14 positioned near the weld portion 16 due to their buffering effect, thereby preventing cracks from occurring there. As a result, the yield after tube expansion can be increased, and the reliability of the heat transfer tubes 10 can be improved.

Furthermore, according to the production method of this embodiment, not only is it possible to obtain an exceptional grooved-inner-surface heat transfer tube as described above, but also the finless portions 66 which have been relatively thickened are joined and electrically seam welded, so that the finless portions 66 will not fold inward when they are brought together. As a result, the effect of preventing protrusion of the weld portion 16 inward due to the finless portion 66 sinking can be improved, so as to produce grooved-inner-surface heat transfer tubes with high reliability from this standpoint as well.

[Second Embodiment]

While only a single-stage fin rolling by the grooved roller 14 was performed in the above-described first embodiment, it is also possible to perform at least a two-stage rolling using at least two groove rollers in order to form fins by a second rolling over fins formed by a first rolling, thereby forming intersecting fins.

Figure 11:
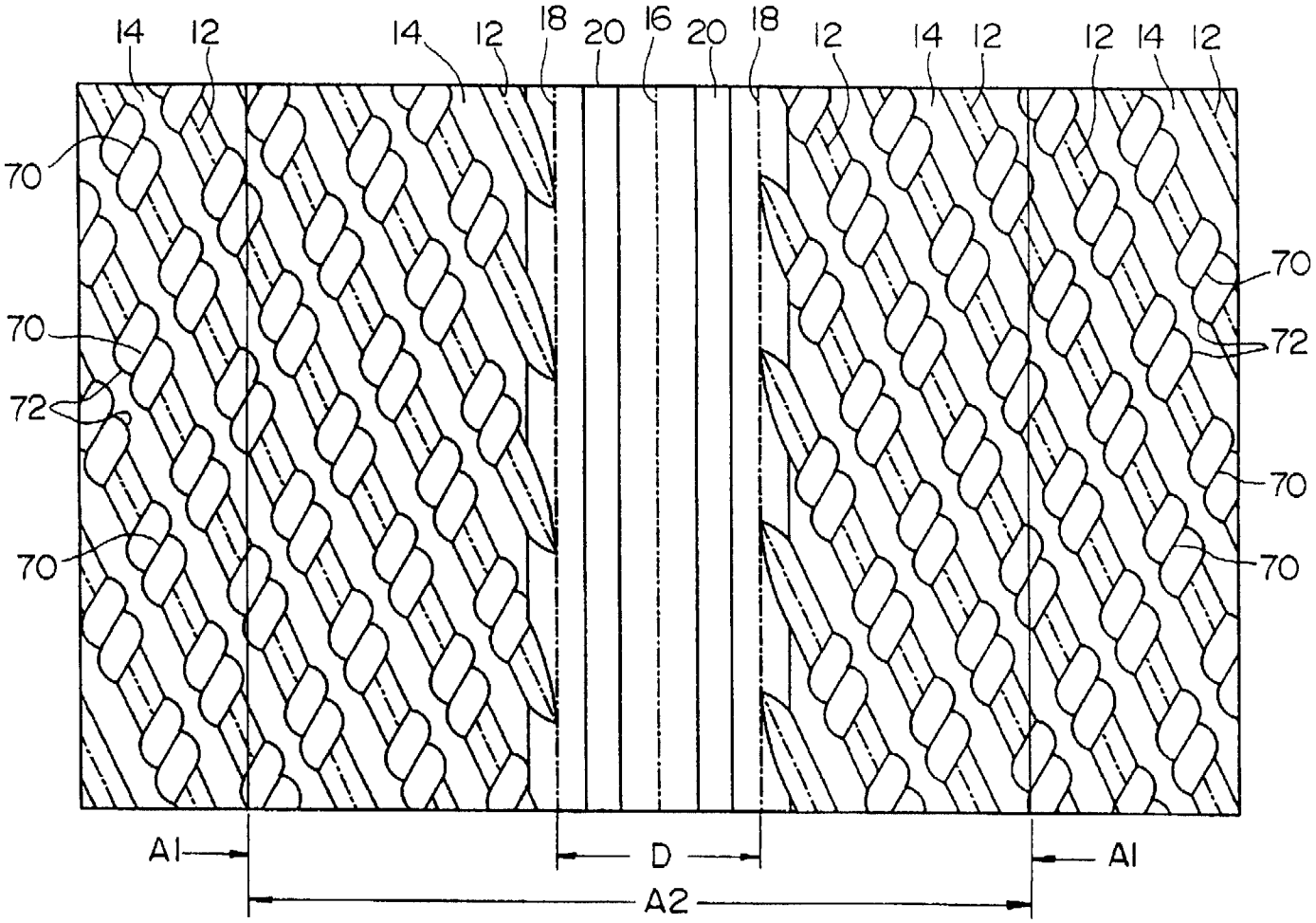
FIG. 11 is a spread-open view showing the inner surface of a second embodiment of the grooved-inner-surface heat transfer tube according to the present invention.

FIG. 11 is a spread-open view of the inner surface of a grooved-inner-surface heat transfer tube obtained in this way, wherein the portions corresponding to those in FIG. 2 are given the same reference numerals and their explanations are omitted. In this heat transfer tube 10, cross-sectional V-shaped grooves 70 which intersect with the fins 12 are formed over the entire surface of the parts on which the fins 12 are formed, so as to separate and shorten these fins 12 by means of these grooves 70, while forming overhangs on both sides of the grooves 70 as a new feature. By forming overhang portions 72 in this way, thin grooves are formed beneath these overhang portions 72. These thin grooves have the effect of promoting nuclear boiling in the thermal medium so as to increase the evaporation efficiency. At the same time, the same effects as the first embodiment can be gained.

[Third Embodiment]

Figure 12:
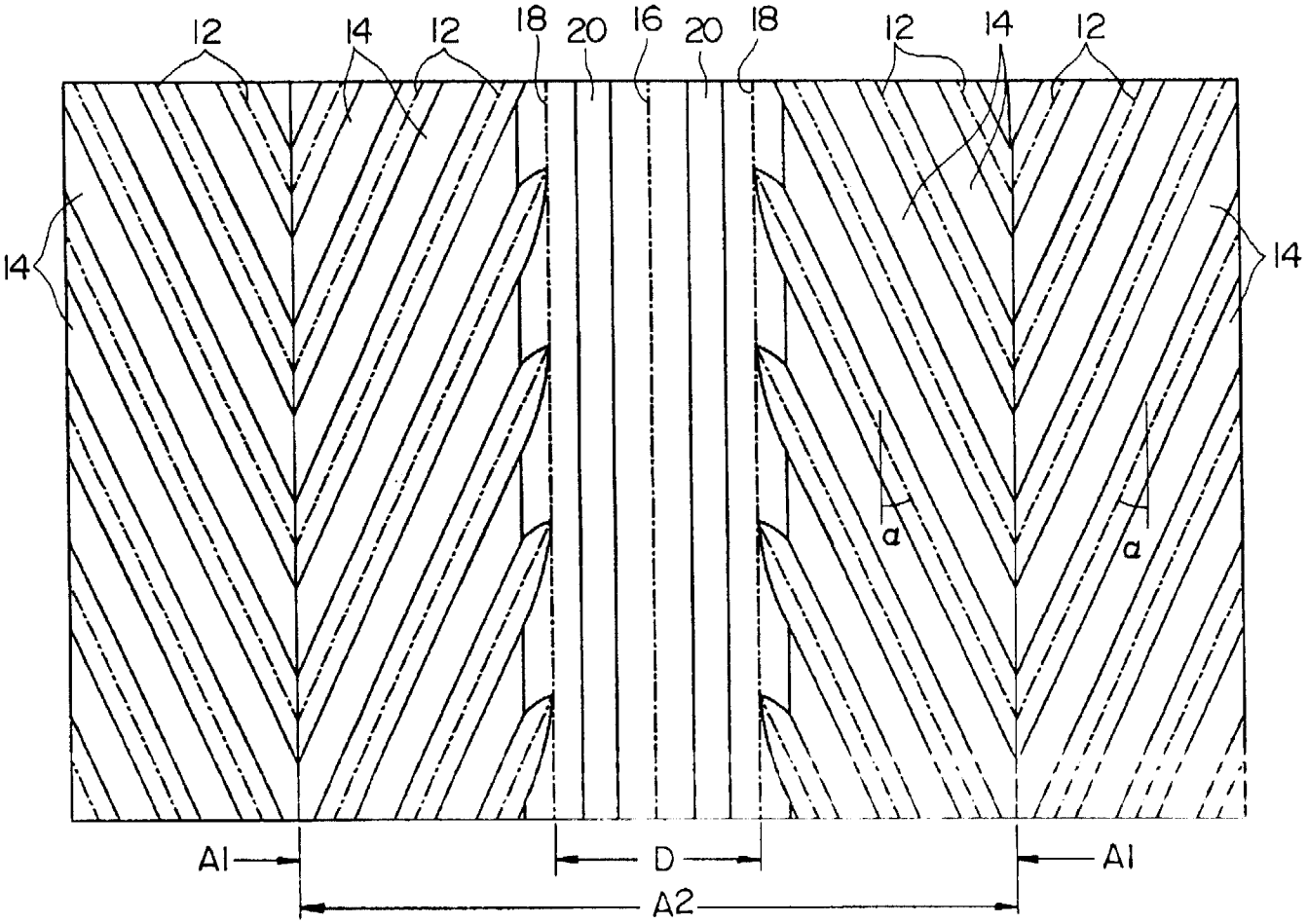
FIG. 12 is a spread-open view showing the inner surface of a third embodiment of the grooved-inner-surface heat transfer tube according to the present invention.

In the first embodiment, the fins 12 have a simple spiral shape, but the fins can be formed into shapes other than spiral shapes in the present invention. For example, the third embodiment shown in FIG. 12 has fins 12 which are V-shaped or W-shaped when flatly viewed, which are arranged so as to be lain out in a circumferential direction. With these types of V-shaped fins 12, the effect of making the thermal medium flow through the heat transfer tube 10 turbulent is improved, so that the heat exchange efficiency can be increased. Of course, the planar shapes of the fins need not be V- or W-shaped, and various modifications, such as C-shapes, are possible, Furthermore, while the fins and spiral grooves are formed on only the inner surface of the heat transfer tube 1 in the above embodiments, the present invention may also be applied to cases wherein fins and grooves are formed on the outer and/or inner surface of the heat transfer tube. Additionally, with the method of the present invention, it is also possible to have a composition wherein a plurality of short fins divided in the longitudinal direction are formed in staggered fashion or along a spiral line; in either case, the basic effects are able to be obtained.

Additionally, it is also possible to have a composition wherein the projecting strip portions 18 are not formed when only a crack prevention effect is to be gained. In that case, the end portions of the fins 12 can be made continuous with the weld portion 16, or groove portions 20 can be formed between the end portions of the fins 12 and the weld portion 16. In either case, the feature wherein the thickness of the metallic tube at the bottoms of the spiral grooves 14 increase in approaching the weld portion 16 is the same.

Furthermore, in the present invention, the composition may be such as to have a plurality of short fins formed in staggered fashion or along spiral lines; in either case, the basic effects described above can be gained.

EXAMPLES

[Experimental Example 1]

The production of a grooved-inner-surface heal transfer tube using the grooved roller 14 having the cross-sectional shape shown in FIG. 8 (the method of the present invention) and the production of a grooved-inner-surface heal transfer tube using a grooved roller identical in shape and dimensions to that of FIG. 8 with the exception that the projecting-strip-portion-forming grooves 60 are not formed, was compared for the end surface shape of the board material after rolling.

The rolling conditions are as follows.

| | |
|---|---|
| Initial Thickness of Board Material B: | 0.44 mm |
| Material of Board Material B: | phosphorus deoxidized copper |
| Maximum Height of Fins 12: | 0.20 mm |
| Minimum Height of Fins 12: | 0.08 mm |
| Pitch of Fins 12: | 0.44 mm |
| Side Surface Angle of Fins 12 (apex angle): | 53° |
| Bottom Width of Spiral Grooves: | 0.20 mm |
| Thickness of Board Material B in Spiral | 0.30 mm |

-continued

| | |
|---|---|
| Grooves Within Area A1: | |
| Maximum Thickness of Board Material B in Spiral Grooves Within Area A2: | 0.33 mm |
| Depth of projecting-Strip-Forming Grooves 60: | 0.50 mm |
| Distance from Center Line of projecting-Strip-Forming Grooves 60 to End Surface of Board Material: | 0.60 mm |

As a result, waving of the end surfaces of the board material B obtained by the method of the present invention absolutely did not occur, while the end surfaces of the board material B of the method of the comparative example without the projecting-strip-forming grooves 60 had a clearly waved shape.

[Experiment 2]

Figure 13:
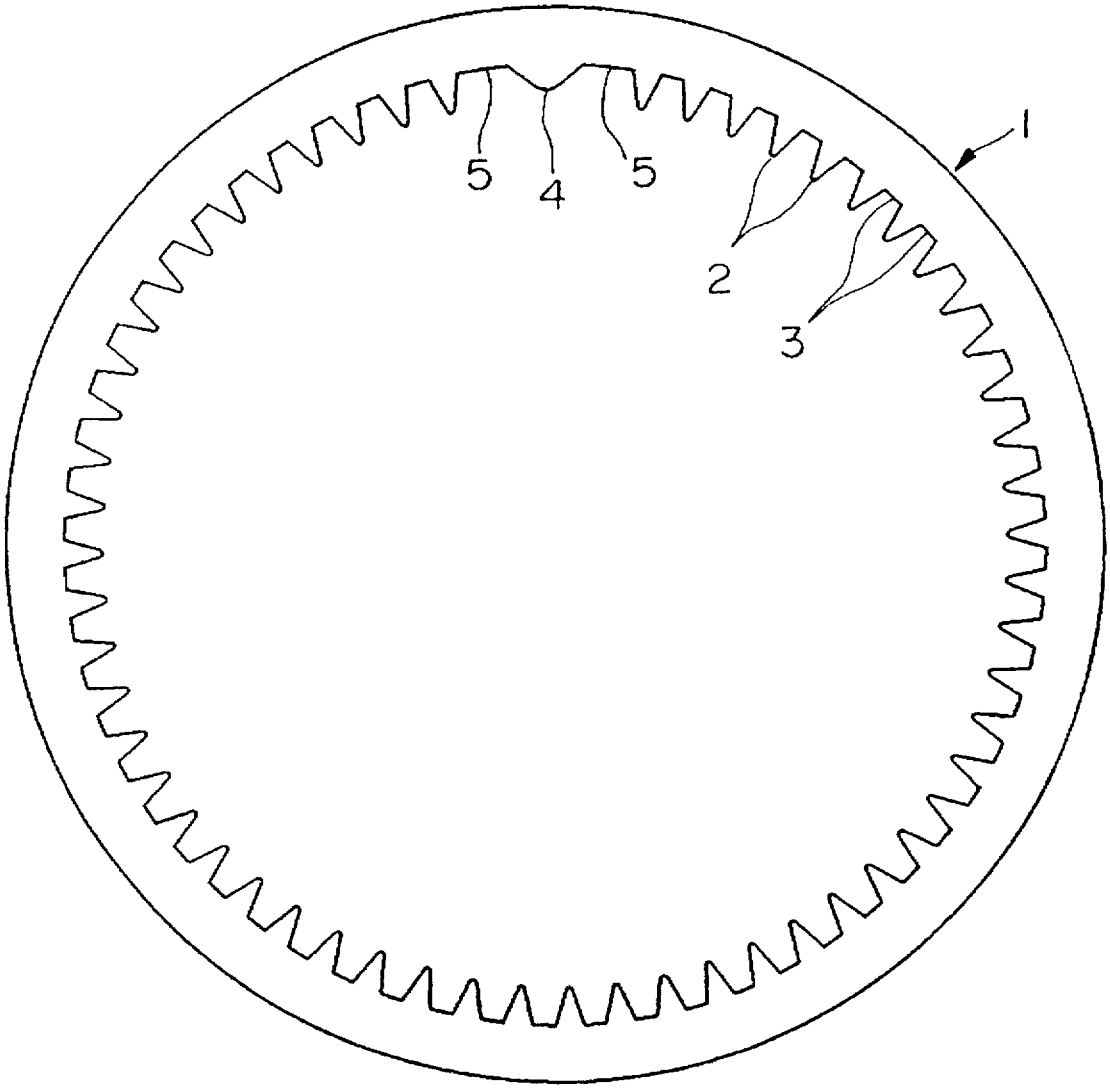
FIG. 13 is a section view showing an example of a conventional grooved-inner-surface heat transfer tube.
Figure 14:
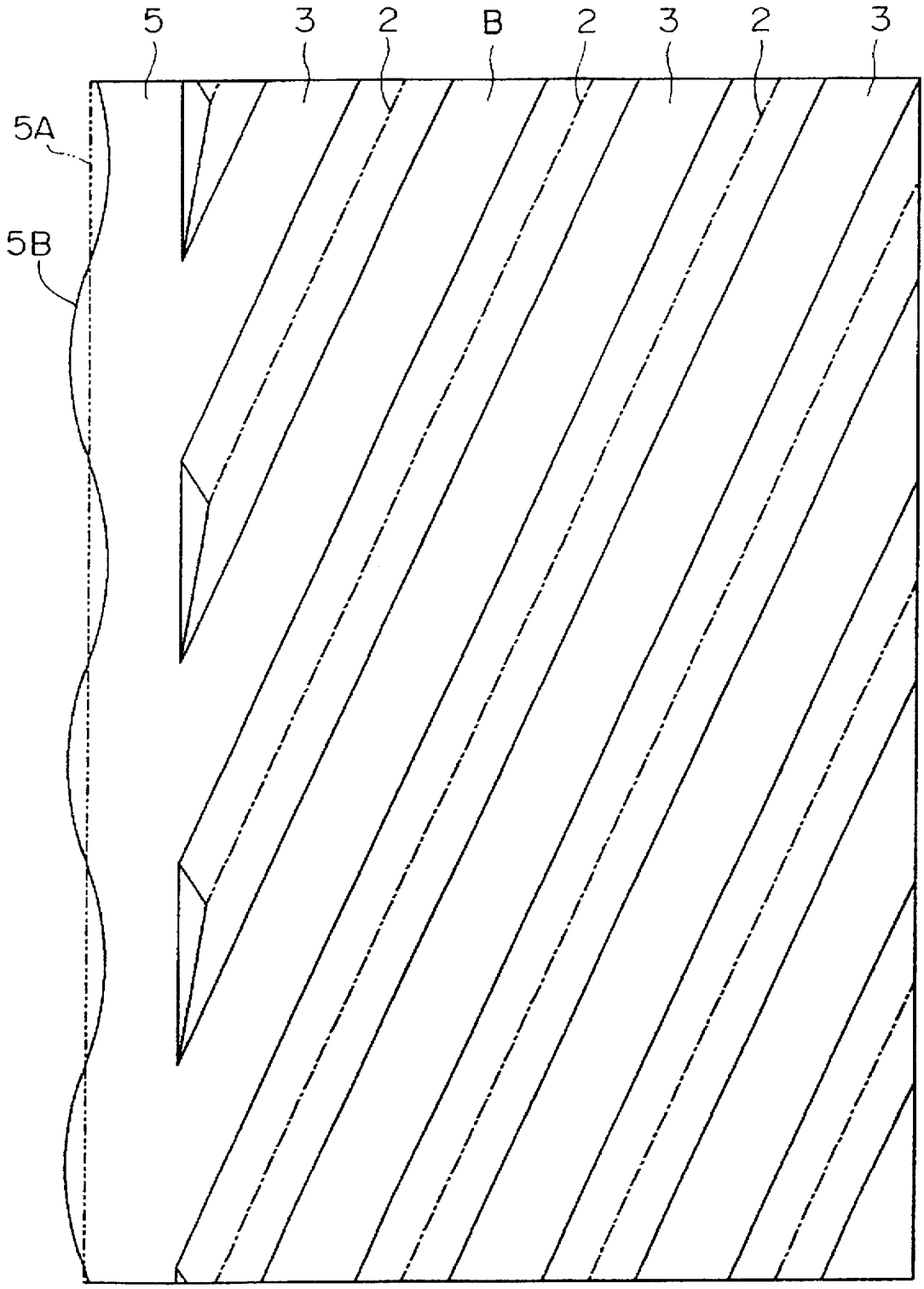
FIG. 14 is an enlarged view showing a first problem point on an end portion of a board material according to the conventional art.

Fifteen each of the grooved-inner-surface heat transfer tubes having the cross-sectional shape shown in FIG. 1 (embodiment) and the grooved-inner-surface heat transfer tubes having the cross-sectional shape shown in FIG. 13 (Comparative Example) were produced, then the tube expansion procedure shown in FIG. 15 was performed and the mouth expansion rate was measured until cracks occurred. The measurements of the heat transfer tubes were as follows.

| | |
|---|---|
| [Common Factors] | |
| Outer Diameter of Heat Transfer Tube: | 9.52 mm |
| Material of Heat Transfer Tube: | phosphorus deoxidized copper |
| Pitch of Fins: | 0.44 mm |
| Side Angle of Fins (apex angle): | 53° |
| Bottom Width of Spiral Grooves: | 0.20 mm |
| Spiral Angle: | 18° |
| Initial Thickness of Board Material: | 0.44 mm |
| [Embodiment] | |
| Maximum Height of Fins 12: | 0.20 mm |
| Minimum Height of Fins 12: | 0.08 mm |
| Thickness in Spiral Grooves 14 at Area A1: | 0.30 mm |
| Maximum Thickness in Spiral Grooves 14 at Area A2: | 0.33 mm |
| Thickness t0 Within Groove Portions 20: | 0.37 mm |
| Height of Projecting Strip Portions 18: | 0.40 mm |
| Height of Weld Portion 16: | 0.48 mm |
| Distance W Between Center Lines of Projecting Strip Portions 18: | 0.95 mm |
| Bottom Width in Spiral Grooves 14 at Area A1: | 0.20 mm |
| Maximum Bottom Width of Spiral Grooves 14 at Area A2: | 0.23 mm |
| [Comparative Example] | |
| Height of Fins 12: | 0.20 mm |
| Height of Weld Portion 16: | 0.48 mm |
| Bottom Width in. Spiral Grooves: | 0.20 mm |
| The tube expansion conditions were as follows: | |
| Tip Angle of Tube Expander: | 60° |

As a result, the mouth expansion rate when cracks formed in the grooved-inner-surface heat transfer tube of the comparative example was an average of 1.30 times, whereas the value for the grooved-inner-surface heat transfer tube of the embodiments was 1.45 times, thereby confirming that cracks are less likely to occur during a tube expansion procedure in the case of the embodiment.

We claim:

1. A heat transfer tube having a grooved inner surface, comprising:

a metallic tube having an inner circumferential surface;

a weld portion formed on the inner circumferential surface of said metallic tube, extending in an axial direction of said metallic tube;

a pair of projecting strip portions formed on the inner circumferential surface of said metallic tube, parallel to said weld portion and separated from said weld portion; and a plurality of fins formed in an area between said pair of projecting strip portions which does not include said weld portion, said fins being formed at an angle which intersects with the axis of said heat transfer tube.

2. A heat transfer tube having a grooved inner surface according to claim 1, wherein ends of said fins are connected to said projecting strip portion.

3. A heat transfer tube having a grooved inner surface according to claim 1, wherein the thickness of said metallic tube inside groove portions formed between said fins increases in approaching said projecting strip portions in areas which are within a constant distance from said projecting strip portions; said fins are formed such that their heights decrease in approaching said projecting strip portions in areas which are within said constant distance form said projecting strip portions; and the thickness of said metallic tube in groove portions between said weld portion and said projecting strip portions is greater than the thickness of said metallic tube in said groove portions formed between said fins.

4. A heat transfer tube according to claim 1, wherein the bottom widths of groove portions formed between said fins are formed such as to gradually increase in approaching said weld portion in an area surrounding said weld portion wherein the central angle is within 30°~90° on both sides from the center of said weld portion.

5. A heat transfer tube having a grooved inner surface according to claim 1, wherein the distance between the center lines of said projecting strip portions is 1~7% of the entire circumference of the inner circumferential surface of said metallic tube.

6. A heat transfer tube having a grooved inner surface according to claim 1, wherein an amount of protrusion of said projecting strip portions from the inner surface of said metallic tube is 10~80% of the amount of protrusion of said fins from the inner surface of said metallic tube.

7. A method for producing a heat transfer tube having a grooved inner surface, comprising:

a rolling step of running a metallic board material between at least one pair of fin forming rollers so as to roll onto a surface of said board material a pair of projecting strip portions parallel to both side edges of said board material and respectively separated from said side edges, and a plurality of fins which are arranged in an area between said projecting strip portions so that said fins are arranged at an angle which intersects with the axis of said heat transfer tube;

a tube forming step of passing the board material onto which said projecting strip portions and said fins have been formed through a plurality of forming rollers so as to form said board material into a tube with said projecting strip portions and said fins positioned on the inside surface; and a welding step of heating both side edges of said board material which has been formed into a tube shape and adjoining said side edges.

8. A method for producing a heat transfer tube having a grooved inner surface according to claim 7, wherein ends of said fins are connected to said projecting strip portions, during said rolling step.

9. A method for producing a heat transfer tube having a grooved inner surface according to claim 7, wherein the thickness of said metallic tube inside groove portions formed between said fins is formed so as to increase in approaching said projecting strip portions in areas which are within a constant distance from said projecting strip portions; said fins are formed such that their heights decrease in approaching said projecting strip portions in areas which are within said constant distance from said projecting strip portions; and the thickness of said metallic tube in groove portions between said weld portion and said projecting strip portions is formed so as to be greater than the thickness of said metallic tube in said groove portions formed between said fins, during said rolling step.

10. A heat transfer tube having a grooved inner surface, comprising:

a metallic tube having an inner circumferential surface;

a plurality of fins formed on said inner circumferential surface of said metallic tube so as to protrude from said inner circumferential surface; and a weld portion formed on the inner circumferential surface of said metallic tube, extending in an axial direction of said metallic tube; wherein the thickness of said metallic tube in groove portions formed between said fins is formed such as to increase in approaching said weld portion in an area surrounding said weld portion wherein the central angle is within 30°~90° on both sides from the center of said weld portion.

11. A heat transfer tube having a grooved inner surface according to claim 10, wherein said fins are formed such that their heights from said inner circumferential surface decrease in approaching said projecting strip portions in said area surrounding said weld portion.

12. A heat transfer tube having a grooved inner surface according to claim 10, wherein the thickness of said metallic tube in said groove portions is held constant in the outer areas on the inner surface of said metallic tube which exclude said area surrounding said weld portion, and the maximum thickness of said metallic tube within said area surrounding the weld portion is 103~125% of the thickness of said metallic tube in said groove portions within said outer areas.

13. A method for producing a heat transfer tube having a grooved inner surface, comprising:

a rolling step of running a metallic board material between al least one pair of fin forming rollers so as to roll onto a surface of said board material a plurality of fins which protrude from said surface, such that the thickness of said board material in groove portions between said fins increases in approaching side edges of said board material within areas around said side edges extending to 10~30% of the width of said board material;

a tube forming step of passing the board material onto which said fins have been formed through a plurality of forming rollers to form said board material into a tube shape with said fins positioned on the inside; and a welding step of heating both side edges of said board material which has been formed into a tube shape and adjoining said side edges.

14. A heat transfer tube having a grooved inner surface, comprising:

a metallic tube having an inner circumferential surface;

a plurality of fins formed on said inner circumferential surface of said metallic tube so as to protrude from said inner circumferential surface; and a weld portion formed on the inner circumferential surface of said metallic tube, extending in an axial direction of said metallic tube; wherein the bottom widths of groove portions formed between said fins are formed such as to gradually increase in approaching said weld portion in an area surrounding said weld portion wherein the central angle is within 30°~90° on both sides from the center of said weld portion.

15. A heat transfer tube having a grooved inner surface according to claim 14, wherein said fins are formed such that their heights from said inner circumferential surface decrease in approaching said projecting strip portions in said area surrounding said weld portion.

16. A heat transfer tube having a grooved inner surface according to claim 14, wherein the bottom widths of said groove portions are held constant in the outer areas on the inner surface of said metallic tube which exclude said area surrounding said weld portion, and the maximum bottom width of said groove portions within said area surrounding the weld portion is 102~130% of the bottom width of said groove portions within said outer areas.

17. A method for producing a heat transfer tube having a grooved inner surface, comprising:

a rolling step of running a metallic board material between al least one pair of fin forming rollers so as to roll onto a surface of said board material a plurality of fins which protrude from said surface, such that the bottom widths said groove portions between said fins increases in approaching side edges of said board material within areas around said side edges extending to 10~30% of the width of said board material;

a tube forming step of passing the board material onto which said fins have been formed through a plurality of forming rollers to form said board material into a tube shape with said fins positioned on the inside; and a welding step of heating both side edges of said board material which has been formed into a tube shape and adjoining said side edges.

* * * * *

UNITED STATES PATENT AND TRADEMARK OFFICE

CERTIFICATE OF CORRECTION

PATENT NO. 5,704,424

DATED January 6, 1998

INVENTOR(S) Kohno et al.

It is certified that error appears in the above-identified patent and that said Letters Patent is hereby corrected as shown below:

On the title page,

In Section [73] Assignee:, delete "Shindowh" and insert --Shindoh--.

Column 1, line 36, delete "together with" and insert --together. With--.

Column 2, line 11, delete "formed" and insert --formed,--.

Column 2, line 13, delete "reason" and insert --reason,--.

Column 7, line 18, delete "to" and insert --t0--.

UNITED STATES PATENT AND TRADEMARK OFFICE

CERTIFICATE OF CORRECTION

PATENT NO. : 5,704,424
DATED : January 6, 1998
INVENTOR(S) : Kohno et al.

It is certified that error appears in the above-identified patent and that said Letters Patent is hereby corrected as shown below:

Column 8, line 16, delete "tow" and insert --low--.

Column 8, line 35, delete "W, In" and insert --W. In--.

Column 12, line 48, delete "heal" and insert --heat--.

Column 12, line 51, delete "heal" and insert --heat--.

Column 13, line 5, delete "projecting-Strip-Forming" and insert --Projecting-Strip-Forming--.

Column 13, line 7, delete "projecting-" and insert --Projecting---.

Column 13, line 53, delete "in." and insert --in--.

Column 16, line 42, delete "al" and insert --at--.

Signed and Sealed this

First Day of September, 1998

Bruce Lehman

*Attest:*

BRUCE LEHMAN

*Attesting Officer*

*Commissioner of Patents and Trademarks*